US006318583B1

(12) United States Patent
Owens

(10) Patent No.: US 6,318,583 B1
(45) Date of Patent: Nov. 20, 2001

(54) BEADED CONTAINER

(75) Inventor: Edward F. Owens, Lisle, IL (US)

(73) Assignee: United States Can Company, Lombard, IL (US)

( * ) Notice: Subject to any disclaimer, the term of this patent is extended or adjusted under 35 U.S.C. 154(b) by 0 days.

(21) Appl. No.: 09/524,870

(22) Filed: Mar. 14, 2000

(51) Int. Cl.[7] ..... B65D 41/00
(52) U.S. Cl. ..... 220/672; 220/669; 215/384
(58) Field of Search ..... 220/672, 669, 220/601, 619; 215/382, 383, 384

(56) References Cited

U.S. PATENT DOCUMENTS

| | | | | |
|---|---|---|---|---|
| 2,339,763 | | 1/1944 | Calleson et al. . | |
| 2,950,839 | | 8/1960 | Hahn . | |
| 3,272,383 | | 9/1966 | Harvey . | |
| 3,279,640 | | 10/1966 | Dodson . | |
| 4,313,545 | * | 2/1982 | Maeda | 220/619 X |
| 4,775,071 | * | 10/1988 | Giggard | 220/619 |
| 5,339,977 | * | 8/1994 | Schormair et al. | 220/672 X |
| 5,878,906 | * | 3/1999 | Bolton et al. | 220/619 X |
| 6,065,624 | * | 5/2000 | Steinke | 220/672 X |

* cited by examiner

*Primary Examiner*—Steven Pollard
(74) *Attorney, Agent, or Firm*—Polster, Lieder, Woodruff & Lucchesi, L.C.

(57) ABSTRACT

An aerosol container (10) with an ergonomic beaded cylindrical body (18) is disclosed. The cylindrical body (18) has larger beads (21–23) toward the top of the container, and smaller beads (24, 25) positioned under the larger beads, creating an easy to hold and use container.

16 Claims, 3 Drawing Sheets

BEADED CONTAINER

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to aerosol containers, and more particularly, to an aerosol container with a unique beaded cylindrical body.

Aerosol containers containing a wide variety of active components such as insect repellents, insecticides, hair sprays, creams or foams and so on have been marketed widely for household, commercial or industrial purposes. A conventional aerosol container is a four-piece assembly. It includes a body made up of a sidewall, a bottom wall secured to the sidewall by a bottom chime seam, a dome shaped top wall joined to the sidewall by a chime seam, and an aerosol device closing an opening in the top and joined to the top wall by a crimp to form a metal container. An aerosol valve for dispensing the fluid contents of the container is typically mounted to the dome along the axis of the cylindrical metal container. The container is filled with a fluid product to be dispensed and is mixed with a propellant so as to be pressure discharged from the container through a dispensing valve. Associated with the dispensing valve is a dip tube which extends toward the bottom of the container. It has been quite common to cover the domed end of an aerosol container and the dispensing valve attached thereto, by a cover referred to commonly as an overcap. Such overcaps typically snap over the doubleseam or over a snap bead which is normally formed in the dome somewhere near the cylindrical wall of the metal container body.

In accordance with the present invention, there is provided a container for housing a spray aerosol container having a tubular body with a spray orifice adjacent one end thereof. A movable top closure is positioned in the tubular body and, when depressed, the closure activates the spray section. The normal return force of the spray section, after it has been depressed, returns the top closure to its rest position against the end of the body. The cylindrical body of the container is formed with beads about its circumference. The beads provide additional strength to the container body, so that increased height may be obtained without increasing the thickness of the cylindrical wall. The container of the instant invention provides a functional but attractive, streamlined and esthetic package which is easy to assemble and to manufacture, ergonomic, and provides superior strength and resistance to vacuum paneling.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention. it is intended that all matter contained in the above description or shown in the accompanying drawings shall be interpreted as illustrative and not in a limiting sense.

Figure 1:
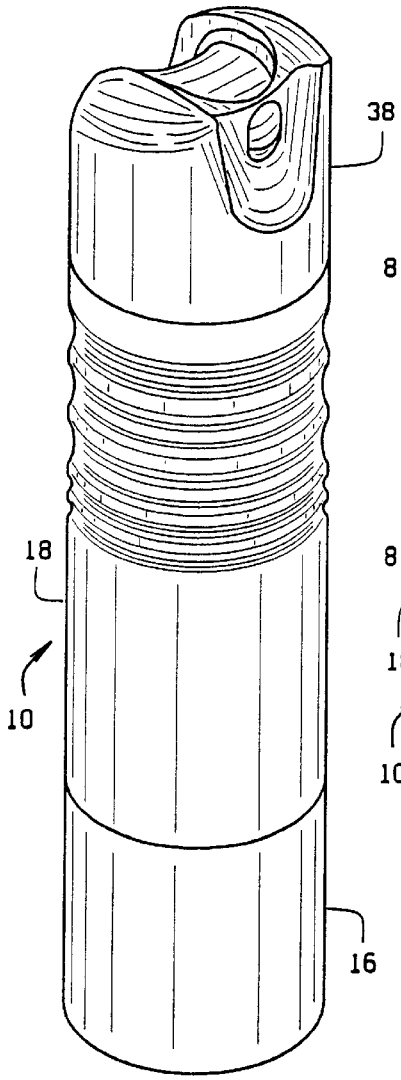
FIG. 1 is a perspective view of the beaded aerosol can of the present invention in side elevation.
Figure 2:
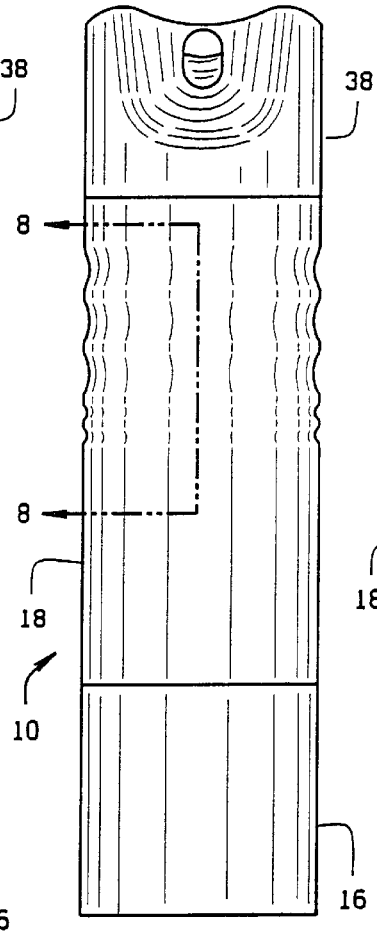
FIG. 2 is a view of a beaded aerosol container of the present invention in front elevation
Figure 3:
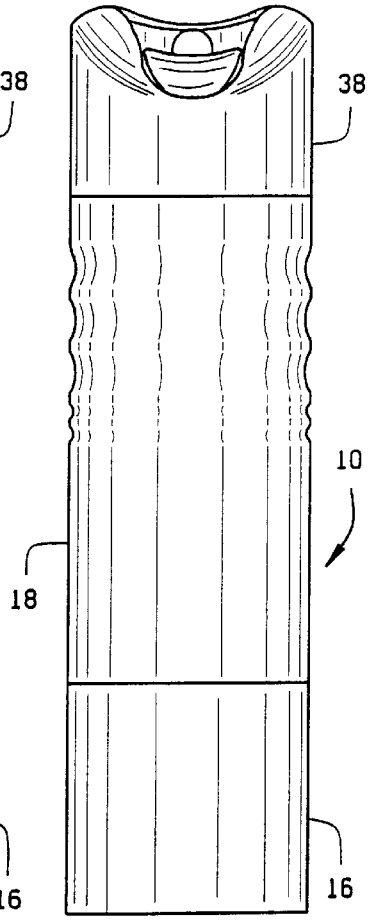
FIG. 3 is a view of a beaded aerosol container of the present invention in rear elevation.
Figure 4:
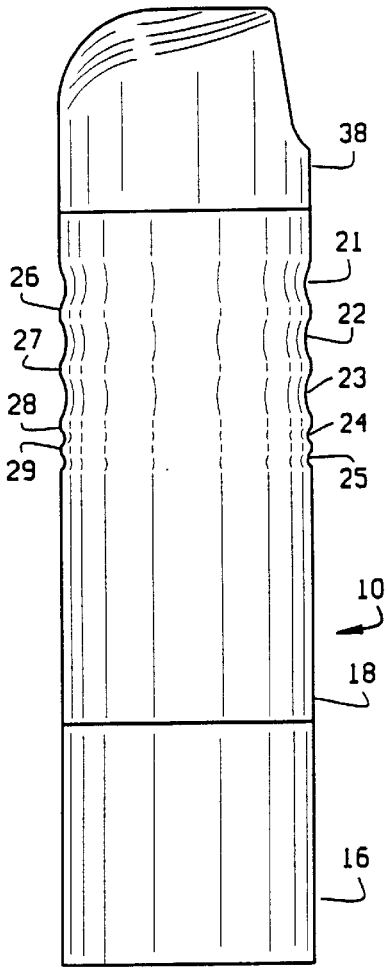
FIG. 4 is a view of a beaded container of the present invention in left side elevation.
Figure 5:
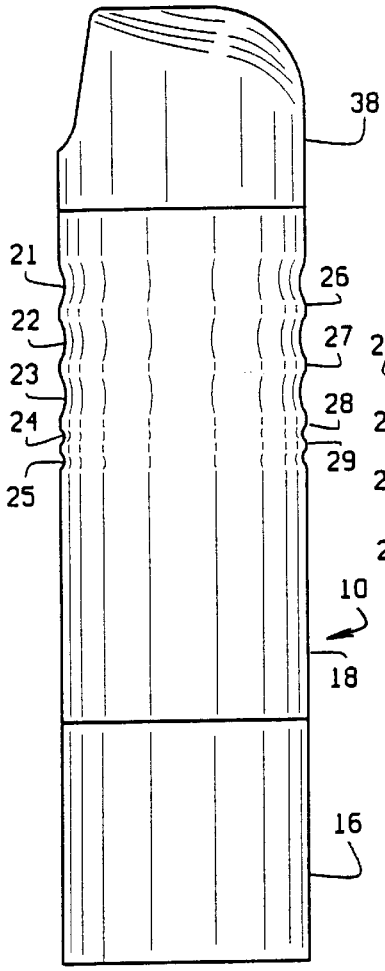
FIG. 5 is a view of a beaded container of the present invention in right side elevation.
Figure 9:
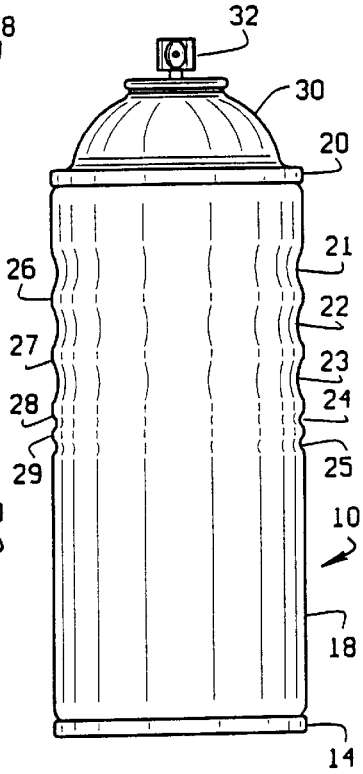
FIG. 9 is a view in side elevation of an aerosol container of the present invention without an overcap or dispenser.
Figure 6:
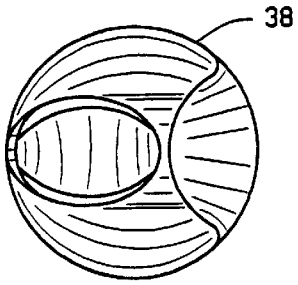
FIG. 6 is a top plan view of an aerosol container of the present invention.
Figure 7:
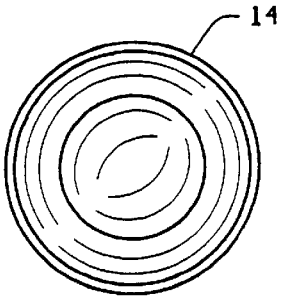
FIG. 7 is a bottom plan view of an aerosol container of the present invention.

Referring to FIG. 9, an aerosol container 10 has a bottom section 14, a generally cylindrical body 18, a domed top portion 30, and valve means 32. Domed top 30 is permanently secured to the generally cylindrical body 18 by conventional means, such as the formation of a chime seam, for example. The valve means 32 is in all respects conventional, and forms no part of the present invention. The bottom section 14 is likewise in all respects conventional, and well known in the art. The bottom section 14 is preferably attached to the generally cylindrical body portion 18 by known means, such as by formation of a chime seam, for instance. It is to be understood that in a two piece can, the bottom portion of the can could be formed integrally with the body section, as is well known in the art.

Figure 8:
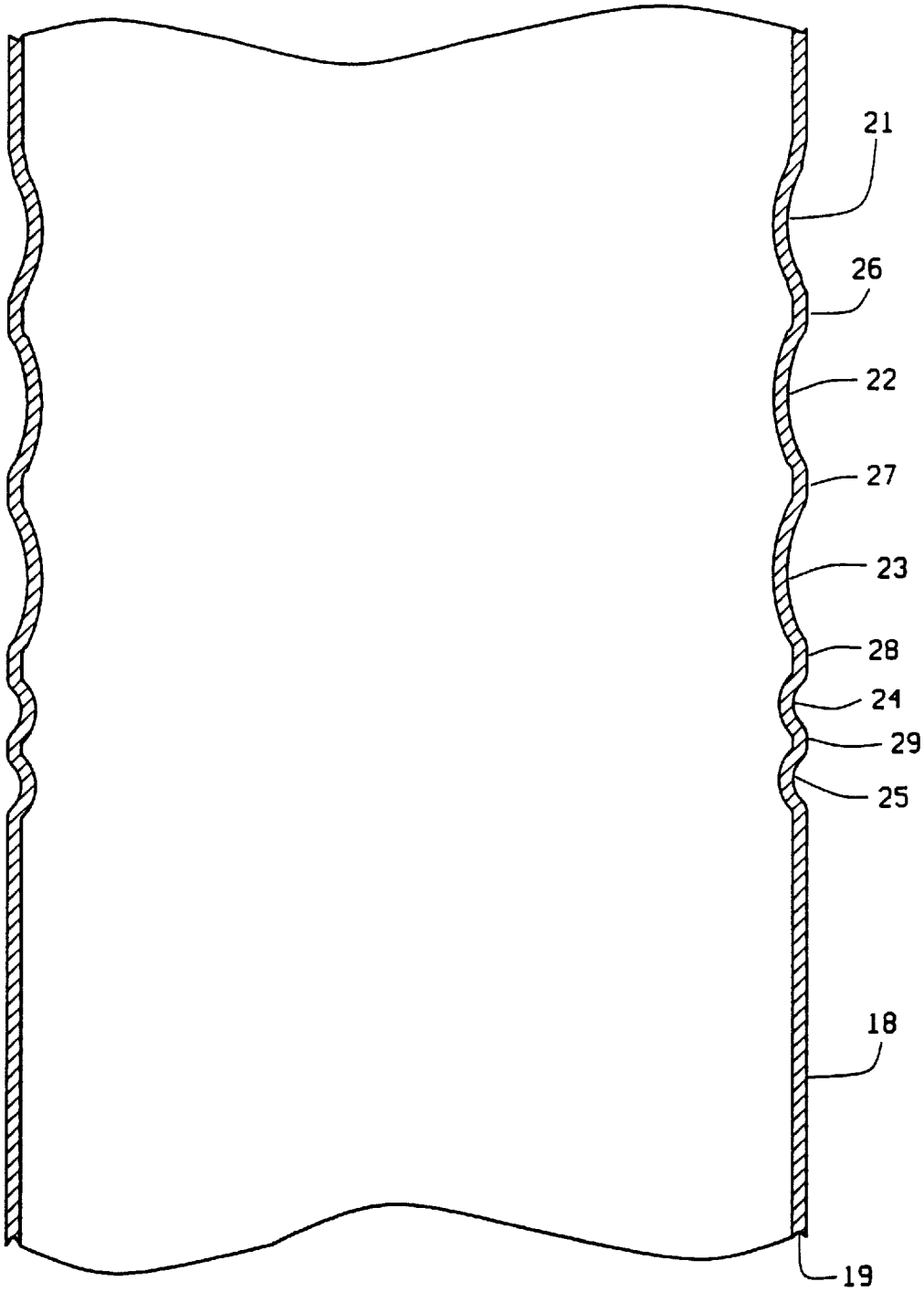
FIG. 8 is a partial cross sectional view of an aerosol container of the present invention.

The cylindrical body 18 is preferably formed of steel. Referring now to FIG. 8, inner and outer surfaces of cylindrical body 18 define a wall thickness 19 of predetermined size. The upper part of cylindrical body 18 preferably has a reduced diameter portion 20, or is "necked" as this feature is commonly referred to in the art. The necked portion 20 is at the junction of the cylindrical body 18 and the dome portion 30 as shown in FIG. 9. Of course, the necked portion is optional, and forms no part of the present invention. Alternatively, the body portion 18 could meet the domed top portion 30 without the reduced diameter. The domed portion 30 is attached to the generally cylindrical body again by well known means, such as the formation of a chime seam.

Referring to FIGS. 1–5, the preferred embodiment of the present invention provides for a dispenser 16, and an overcap 38. Dispenser 16 is preferably formed of plastic, so that it is moderately deformable. Dispenser 16 is generally cylindrical, and preferably fabricated to be snap-fit over bottom section 14. The dispenser holds disposable rags or towels (not shown) for cleaning or dusting, with container 10 being used to spray a cleaning or dusting agent on a surface to be treated.

The cylindrical body 18 has an outer surface with a plurality of beads 21–25 formed as annular channels extending around the circumference of the surface of the cylindrical body 18. As best seen in FIG. 8, in cross section, the beads 21–25 arc arcuate. Raised spaces on cylindrical body 18 between beads 21–25 define rings 26–29. Beads are well known in other containers, for instance coffee containers. Such beads are generally uniform within a given container, and are not of a different size as are the beads 21–25. Such uniform beads are formed with conventional beading devices, which are well known in the art.

It has been found that the formation of beads 21–25 and rings 26–29 impart superior strength and resistance to internal vacuum in the cylindrical body. Therefore, the height of the cylindrical body 18 may be increased without increasing the wall thickness 19 of the cylindrical body 18. These characteristics are known in other containers, especially for resistance to stresses created in vacuum packaging such as with coffee cans. It has been discovered, however, that the beads 21–25 and rings 26–29 form ergonomic spaces for the fingers of a user to grip comfortably when oriented such that three upper beads 21. 22 and 23 are of a larger cross sectional diameter than the two lower beads 24 and 25. To this end, in the preferred embodiment the upper beads 21 22 and 23 each have a cross sectional radius of about 0.2 inches, and a vertical distance between beads of about 0.6 inches. The lower beads 24 and 25 each have a cross sectional radius of about 0.08 inches, and a vertical distance between beads of about 0.3 inches. Thus, the fingers of the user of the container 10 may comfortably grip the container 10 around the beads 21–25. In addition, the vertical distance between the bead 21 and the bead 25 is preferably about 2 inches. This combination of larger beads 21–23 toward the domed top portion 30 and smaller beads 24 and 25 below the larger beads has been found to be ergonomic.

In view of the above, it will be seen that the several objects and advantages of the present invention have been achieved and other advantageous results have been obtained.

Having thus described the invention, what is claimed and desired to be secured by Letters Patent is:

1. An aerosol container sized to be hand-held comprising:

a base portion;

a domed top portion having valve means; and a generally cylindrical body portion intermediate said base portion and said domed top portion, said generally cylindrical body portion having an outer circumferential surface for gripping the aerosol container with a hand, said outer circumferential surface including a plurality of beads formed around a portion of said generally cylindrical body portion whereby a user can manipulate the aerosol can; said plurality of beads including at least one bead of a first size and at least one bead of a second size; said bead of said first size being larger than said bead of said second size.

2. The aerosol container of claim 1 wherein said outer circumferential surface includes three beads of said first size and two beads of said second size formed around a portion of said diameter of said generally cylindrical body portion.

3. An aerosol container sized to be hand-held comprising:

a base portion;

a domed top portion, said domed top portion having a valve means; and a generally cylindrical body portion intermediate said base portion and said domed top portion, said generally cylindrical body portion having an outer circumferential surface for gripping the aerosol container with a hand, said outer circumferential surface including a plurality of beads formed around a portion of said generally cylindrical body portion whereby a user can manipulate the aerosol can, said beads comprising a plurality of beads of a first size and a plurality of beads of a second size, said beads of said first size being larger than said beads of said second size; said plurality of beads of said first size being grouped together and said plurality of beads of said second size being grouped together, said group of first size beads being above said group of second size beads.

4. The aerosol container of claim 3 wherein said group of first sized beads are positioned on said generally cylindrical body portion toward the domed top portion.

5. The aerosol container of claim 3 wherein the first sized beads measure about 0.2 inches in cross sectional radius.

6. The aerosol container of claim 3 wherein the second sized beads measure about 0.08 inches in cross sectional radius.

7. The aerosol container of claim 3 wherein a plastic overcap substantially covers said domed top portion and engaging said valve means.

8. An aerosol container, sized as to be capable of being held in the hand of a user, comprising:

a base portion;

a domed top portion having valve means;

a generally cylindrical body portion intermediate said base portion and said domed top portion, said generally cylindrical body portion having an outer circumferential surface for gripping the aerosol can with a hand; and a first group of beads and a second group of beads formed in said outer circumferential surface around a portion of said generally cylindrical body portion, said first and second group of beads each comprising a plurality of beads; said beads of said first group of beads being separated by a first rib and said beads of said second group of beads being separated by a second rib; said beads of said first group of beads being larger than said beads of said second group of beads; and said first rib being larger than said second rib.

9. The aerosol container of claim 8 wherein said base portion, said domed top portion, and said generally cylindrical body portion are each formed of a material which permits the aerosol container to be permanently secured by conventional means such as a chime seam.

10. The aerosol container of claim 9 wherein said first group of beads is above said second group of beads.

11. The aerosol container of claim 10 wherein the beads of said first group of beads measure about 0.2 inches in cross sectional radius.

12. The aerosol container of claim 10 wherein the beads of said second group of beads measure about 0.08 inches in cross sectional radius.

13. The aerosol container of claim 12 wherein a plastic overcap substantially covers said domed top portion and engaging said valve means.

14. The aerosol container of claim 1 wherein the at least one bead of said first size defines a first radius and said at least one bead of said second size defines a second radius; said first radius being about 2.5 times as large as said second radius.

15. The aerosol container of claim 14 including at least two of said beads of said first size and at least two of said beads of said second size; said beads of said first size being separated by a first rib and said beads of said second size being separated by a second rib; said first rib being about twice the width of said second rib.

16. The aerosol container of claim 15 wherein said first beads have a radius of about 0.2", said second beads have a radius of about 0.08", said first rib has a width of about 0.6" and said second rib has a width of about 0.3".

* * * * *

UNITED STATES PATENT AND TRADEMARK OFFICE

CERTIFICATE OF CORRECTION

PATENT NO. : 6,318,583 B1
DATED : November 20, 2001
INVENTOR(S) : Owens

It is certified that error appears in the above-identified patent and that said Letters Patent is hereby corrected as shown below:

Title page,
ABSTRACT,
Line 1, after the word "ergonomic" insert a -- , --

Column 1,
Line 65, after the word "elevation" insert -- ; --

Column 2,
Line 26, after the word "invention" delete "." replace with a -- , --

Column 3,
Line 20, after the numeral 21 delete "." replace with a -- , --
Line 22, after the numeral 21 insert a -- , --

Signed and Sealed this

Twenty-third Day of April, 2002

*Attest:*

*Attesting Officer*

JAMES E. ROGAN
*Director of the United States Patent and Trademark Office*